United States Patent [19]

Wirth

[11] Patent Number: 4,615,080

[45] Date of Patent: Oct. 7, 1986

[54] METHOD AND APPARATUS FOR MAKING A WEB FROM STAPLE FIBERS

[75] Inventor: Walter Wirth, Duelmen, Fed. Rep. of Germany

[73] Assignee: Hergeth Hollingsworth GmbH, Duelmen, Fed. Rep. of Germany

[21] Appl. No.: 683,534

[22] Filed: Dec. 19, 1984

[30] Foreign Application Priority Data

Dec. 22, 1983 [DE] Fed. Rep. of Germany ..... 3346327

[51] Int. Cl.[4] ..... D01G 15/50

[52] U.S. Cl. ..... 19/106 R; 19/296

[58] Field of Search ..... 19/106 R, 98, 99, 100, 19/101, 108, 296

[56] References Cited

U.S. PATENT DOCUMENTS 3,256,569 6/1966 Draving ..... 19/106 R 4,279,060 7/1981 Wirth ..... 19/296 X

*Primary Examiner*—Louis K. Rimrodt

*Assistant Examiner*—J. L. Olds

*Attorney, Agent, or Firm*—Cort Flint

[57] ABSTRACT

A randomizing web former is provided for producing webs with greater degrees of isotropy than heretofore by including both a carding element, such as a worker roll or a carding segment, and an aerodynamic, centrifugal randomizing web former, employing a jamming action and then free flight of the web to randomize, both on the same toothed cylinder. Usually, the fibrous flock is worked into an array of axially parallel fibers by an assemblage of sequentially arranged carding cylinders and cooperating carding elements such as carding worker rolls and or stationary carding segments similar to flats but of complementary arcuity to the cylinders. Thereupon the web is moved to a toothed roll having both a carding element and a web former either in that sequence or combined so as to act sequentially or concurrently. The resultant randomized web is then doffed.

8 Claims, 4 Drawing Figures

FIG.1
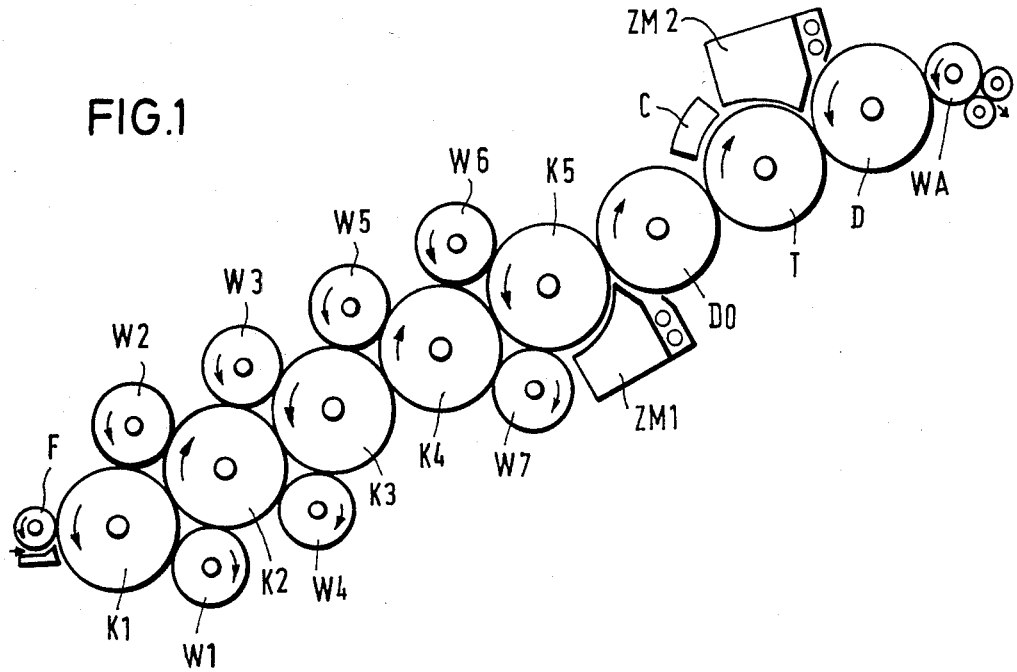
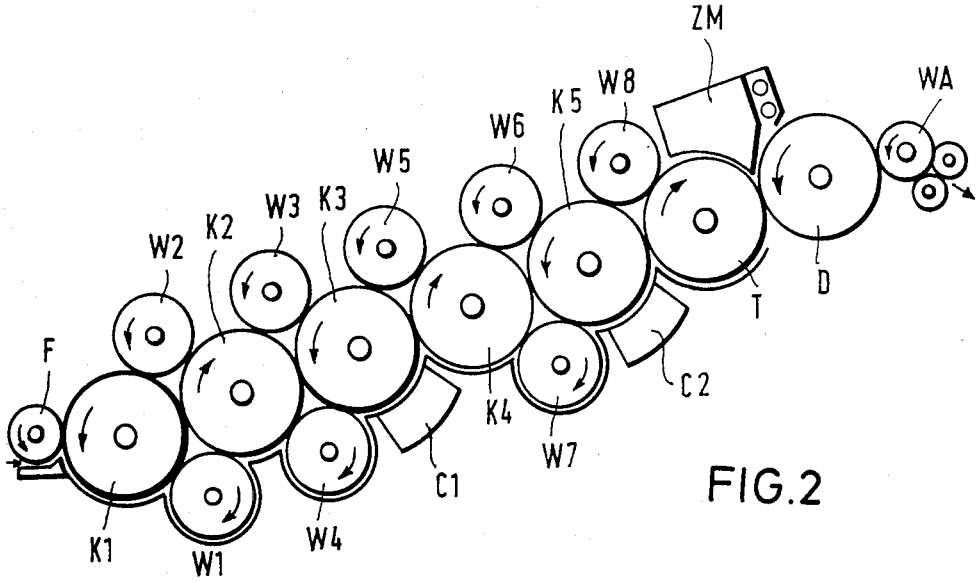
FIG.2

METHOD AND APPARATUS FOR MAKING A WEB FROM STAPLE FIBERS

BACKGROUND OF THE INVENTION

This invention relates to forming a web from staple fibers, and more particularly to method and means for forming a web of such fibers, such as of wool, cotton, man-made materials and so forth, which has enhanced uniformity of properties both in the transverse and longitudinal directions. Yet more particularly, the invention relates to forming such a web with what is known in the art as a random orientation distribution of staple fibers, and which possesses not only an enhanced uniformity of properties such as tear strengths in the transverse and longitudinal directions of the web but in fact enhanced isotropy, which is to say enhanced uniformity of properties along all axes of direction of the web.

The present invention employs centrifugal, dynamic web forming. A means and method therefor known in the art are as disclosed in U.S. Pat. No. 4,279,060 of July 21, 1981. Generally, one uses a carding action to disentangle the staple fibers of fibrous flocks and form a web of a layer of such fibers oriented such that their axes extend more parallel one another and in the direction of fiber flowpath in the process machinery. The resultant web is removed from the carding device and is subjected to an accumulator, or bunching or jamming action to increase its depth to provide a more dense web of greater than one-fiber thickness, and thereafter is subjected to centrifugal aerodynamic forces, so called free web formation, and then doffed from the apparatus. The doffed web then is suitable for use in producing nonwoven fabrics. Depending upon the degree of bunching and after-treatment of the webs produced, the webs are suitable for producing the so-called lightweight nonwoven fabrics, usually of a weight within the range of 8 to 25 grams per square meter of fabric surface area; similarly, one as desired may form medium weight from 25 up to 70 grams per square meter, or heavy weight from 70 up to 250 grams per square meter, nonwoven fabrics.

The means of U.S. Pat. No. 4,279,060 is particularly instructive in understanding the foregoing method. There one employs the well known carding cylinder and doffer; however, interposed therebetween is the centrifugal, aerodynamic web former in the form of an intermediate toothed roller having a set of protruding teeth with the front rake thereof being from zero to just a few angular degrees, whereby the extension of the front rake of the toothing theoretically passes through the center point of the circular path formed by the roller surface bearing the toothing. Coacting with the intermediate roller is a guide plate which generally follows the curvature of the roller but is spaced somewhat away from the roller's surface along the flowpath of material carried by the roller such that the spacing progressively diminishes downstream so that, in an example, at the entry to the space between the teeth and guideplate the spacing may be 4 to 6 millimeters and diminish to a spacing of only 1 millimeter at the region of exiting. This produces what is now known as the accumulating, bunching or jamming action. When the bunched fibrous layer or web leaves the teeth of the intermediate roller, by centrifugal force so to speak, it is flung a short distance, there said to be in example 8 to 12 millimeters, through what is called a free zone passing therethrough in aerodynamic flight until it encounters the teeth of the doffer roll. Evidentally, during such aerodynamic flight the web is freed from the jamming effect and evens out to form the random non-woven web of staple fibers, as a non-woven fabric.

It has been found, however, that the fabric produced shows some anisotropy, though superior to many other prior art nonwovens.

OBJECTS OF THE INVENTION

An object of the invention is to provide method and means for making a nonwoven web of staple fibers which has improved isotropy over what hitherto is known through aerodynamic web formation methods.

Another object is to provide such method and means without the need, as was formerly experienced, of cross-lapping a plurality of webs to improve isotropy.

A further object of the invention is to provide such method and means whereby the web product has improved randomness of fiber orientation over what hitherto was known by aerodynamic means.

Still another object is to provide such method and means whereby the web produced has an enhanced stability over what hitherto was known using aerodynamic means.

These and yet other desirable objects of the invention are attained through the method and means more fully explained below and as defined by the claims.

SUMMARY OF THE INVENTION

According to the invention, in forming a randomly axially oriented web of staple fibers by means of the centrifugal, dynamic web forming process, the improvement comprises carding the web and centrifugally randomizing the web in immediate sequence to one another or concurrently with one another respectively at adjacent or coincident loci to one another. It has now been found that by conducting the operations of carding followed or concurrent with the jamming, and then freeing of the web as in centrifugal, dynamic web reorienting, in as close an interval of time or concurrent interval as is possible, one obtains a web product of yet more enhanced isotropy than was hitherto known. This improved process may be pursued by means of the invention wherein a carding element, such as a curvilinear carding segment as a worker roll or like member, and the randomizing guide surface or slot of the randomizing web former are positioned immediately adjacent to one another as in sequence or to be coincident with one another along the flowpath of the web adjacently spaced from a toothed or pinned roller surface. Further, according to the invention, the aforesaid immediately sequential or concurrent carding plus randomizing web reorientation may follow a precarding operation and or may be followed by further carding and or further randomizing web reorientation by centrifugal, web forming means and so forth.

The aforesaid nature of the invention is such as to provide the operator with an unusual flexibility in determining and prescribing the exact properties desired in the end web nonwoven product, together with conditions for least processing costs, the optimal use of available space for processing machinery, and so forth.

Although at this time it is not fully understood why one obtains the distinct advantages of enhanced isotropy and more complete randomization of the axes directions of constituent fibers subsisting in the family of planes of the web product in which they reside, it is believed that there is some synergistic effect produced by the very close proximity or coincidence in time of the working of the constituent fibers by the carding action and by the jamming, freeing and free flight randomization of fiber axes directions of the centrifugal web forming action. Whatever the mechanism may be, the effect produced however is readily seen by pursuing the present process through the use of the present means therefor.

DESCRIPTION OF THE DRAWINGS

This invention is better understood through the descriptions which follow when taken in conjunction with the appended drawings in which:

FIG. 1, a diagrammatic view in side elevation, shows an embodiment of the means of the invention employing two combinations thereof substantially in tandem to one another;

FIG. 2, in similar view, shows another embodiment of the means of the invention employing a single combination thereof together with substantial precarding;

PREFERRED EMBODIMENTS

Figure 3:
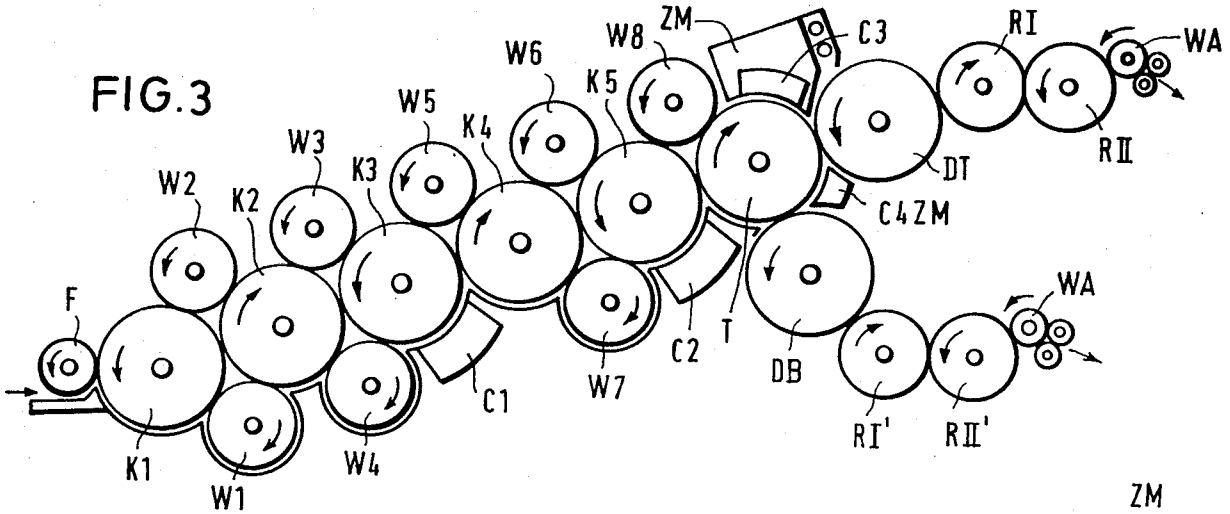
FIG. 3, also in similar view to that of FIG. 1, shows yet a further embodiment of the means of the present invention, employing a combination thereof together with a dual take-off for two issues of web product.

With reference to the drawings, in FIG. 1 is shown an embodiment of the instant means of the invention employing a plurality of relatively small diameter carding cylinders sequentially mounted to receive web one from another, and designated respectively K1 through K5. Coacting with carding rolls K1 through K5 are carding elements in the form of worker rolls, designated W1 through W7. Following carding roll K5 and aligned and mounted to receive in sequence the fibrous web being processed are doffer roll D0, toothed roll T, another doffer roll D, a take-off roll WA and a pair of cooperating idler rolls (not otherwise identified). Also set adjacent to the peripheral surfaces of carding roll K5 and toothed roll T are the plurality of centrifugal aerodynamic randomizing web formers designated respectively ZM1 and ZM2; also adjacent to both toothed roll T and the web former ZM2 and upstream of the latter is mounted carding element C in the form of a carding segment of the type described and defined in U.S. Pat. No. 3,604,062. Such segments are commercially available under the product designation CARDMASTER® Carding Segment or Plate (manufactured by John D. Hollingsworth on Wheels, Inc. of Greenville, S.C., U.S.A.), and generally are in the form of fixed carding segments with wire clothing on a backing which generally conforms to the curvature in a complementary fashion of that of the carding or toothed cylindrical roller with which it cooperates to effect a carding action on fibers.

Respecting this construction, one notes that there are two sets of working combinations of carding element followed immediately by web former. The first set comprises worker roll W7 followed, along the flowpath of material being processed, immediately by web former ZM1, both operators coacting with toothed roll (with card clothing) designated K5. The second set of working combination of carding element plus web former comprises carding segment C followed immediately by web former element ZM2, both operators coating with toothed roll T.

In operation, the embodiment of FIG. 1 receives fibrous flock at its left, designated by the arrow, otherwise unmarked, at its feed roll F from the trough therebeneath (otherwise undesignated). Feed roll F is toothed and, moving in its arrowed direction of rotation, moves the fibrous mass onto the toothed surface of carding cylinder K1. There the fibers are carded through the cooperative coacting of worker rolls W1 and W2 with carding roller K1, moving as indicated by the arrows. Transfer from carding roll K1 to roll K2 is made in the usual manner, with the web following the direction of the arrow on roll K2 until it is similarly transferred to carding roll K3 in the same way. At K2, the web is carded by the coaction of teeth on worker rolls W1, W2, W3 and W4 with the toothing (card clothing) on carder roll K2. Similarly, respecting carding roll K3, further web carding is pursued by coaction of worker rolls W3, W4 and W5 with roll K3. Analogously, the web following transfer to the next succeeding carding roll K4 is still further carded by coaction of worker rolls W5, W6 and W7 with carding cylinder K4. At this juncture, the web transferred from carding roll K4 to carding roll K5 has had its constituent fibers axially aligned with one another to a fairly high degree of parallelism in the direction of web movement as indicated by the arrows which designate the rotational senses of movements of the sundry carding rollers. Most fibers of the web are transferred from the peripheral surface of carding roll K4 to the peripheral surface of roll K5 at about the line of closest approach of roll K4 to roll K5 (which extends into the paper at FIG. 1 and bisects the line which may join their centers of rotation). This web once so transferred is worked in a carding action by coaction of worker roll 7 with carding cylinder K5; almost immediately thereupon, the just carded web is subjected to the jamming, bunching, accumulating action when moved between the toothed surface of carding roll K5 and the adjacent surface of web former ZM1, through the slot thus formed which progressively diminishes in width or depth as hereinbefore described. As the bunched web passes beyond the right hand edge of the slot formed between carding roll K5 and the upper plate as shown of web former ZM1, it moves in free aerodynamic flight under the impetus of centrifugal forces for the short distance to the imaginary plane joining the rotational centers or axes of carding roll K5 and doffer cylinder D0 whereat the fibers encounter the toothing of roll D0 and are transferred thereto as a randomized web, hereinbefore defined. This web is then rapidly transferred to toothed cylinder T in the usual manner. At roller T, the web is subjected to carding by the coaction of the carding segment C, and then again almost immediately subjected to the action of web former ZM2, acting in similar fashion to former ZM1. The resultant web received from roller T by doffer cylinder D has been yet further randomized respecting the axial orientations in the lengthwise and transverse directions of the web, which is called a "re-randomization." The re-randomized web is transferred from doffer D to take-off roll WA and issued through the idler rolls which follow roll WA for further processing or as a product, as desired by the end user.

Certain types of fibrous stock lend themselves felicitously to the tandem re-randomization process just now described to produce a product having a better degree of isotropy than was hitherto known for such stock types. Other stock types of fibrous flock, on the other hand may not require the very vigorous reworking as shown in FIG. 1 in order to achieve an acceptable degree of properties isotropy for some end use contemplated. This acceptable degree may result from processing using, for example, the embodiment as shown in FIG. 2, which latter employs but a single working (in the sense of working the fibers as this term is known in the art) combination of carding element, in this instance a worker roll W8, followed almost immediately in fiber flowpath by the web former ZM.

In the FIG. 2 embodiment, a greater degree of carding is exerted prior to the web being subjected to the working combination of carding element plus web former. For example, in a comparison with the FIG. 1 embodiment, a carding segment C1 is added to worker rolls W3, W4 and W5 in the carding of the stock with carding cylinder K3. Also, another carding segment C2 is added, replacing the web former ZM1 of the FIG. 1 embodiment, to coact with carding cylinder K5. Also added to the complement of carders coacting with cylinder K5 is an additional worker roll W5. In this embodiment, only one doffer roll is needed, and so it further differs from that in FIG. 1 by deletion of doffer D0, and putting the succeeding group of toothed roller T, doffer roll D and take-off roll WA and its idler rolls immediately following carding cylinder K5. With the addition of worker roll W8 in the position adjacent to not only carding cylinder K5 but also its now neighboring toothed roller T, worker roll W8 can and does now take the place of the carding segment C used in the FIG. 1 embodiment to act also as the carding element portion of the combination of the invention of carding element followed almost immediately by randomizing aerodynamic web former.

Thus, as alluded to, the use of but one or two tandemly arranged combinations of sets of carder plus web former is a matter which one may choose depending upon the nature of the stock of fibrous flock employed in the web formation or the qualities desired in the randomized web product obtained. By this one readily understands that use of a plurality of any desired number of carders with carding rollers and of one or a plurality of any desired number of sets of combinations of the invention of carder plus web former. The high degree of flexibility in choice of such processing means now lends great flexibility at very low costs in producing a randomized web product with any desired degree of randomization of fiber axes, and so of isotropy of web product.

Figure 4:
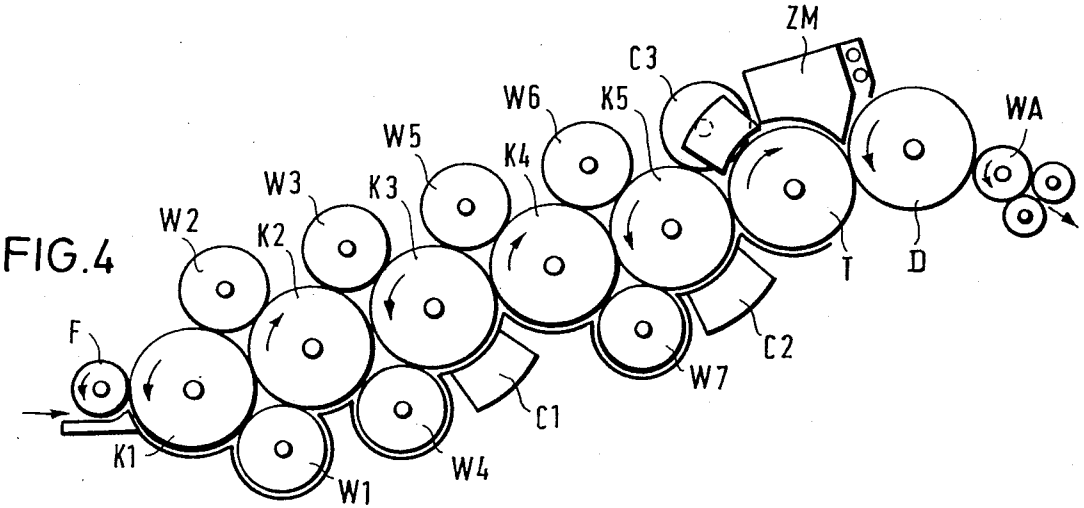
FIG. 4 is a further diagrammatic view in side elevation of another embodiment of the invention showing a further combination thereof with substantial precarding.

This flexibility of choice is further illustrated in the embodiment shown in FIG. 4. The construction of this embodiment is largely identical to that of the embodiment in FIG. 2; however, in place of the latter's worker roll W8 used in the combination just prior to web former ZM, in this embodiment is used a carding element which is a combination in itself of a carding segment such as has previously been described together with a worker roll; this combination carder which provides more intense a carding action than working roller W8 alone is designated C3. Thus this combination carder C3 in accordance with the invention immediately precedes the web former ZM.

According to the invention, one indeed may form a randomized split web, by using the means illustrated in FIG. 3. Forming a split carded web is well known in the art; here, however, one may apply the means and principles of the invention to provide the split web in randomized form. For this embodiment, one employs a unique combination of carder and web former, wherein the carder in the form of a carding segment actually becomes also a part of the randomizing web former. In this embodiment, one employs the carding segment C3 with its depending toothed surface also as the guiding surface which defines the passageway slot together with the toothed surface of cylinder T of progressively diminishing depth. This produces a carding effect on the web concurrently with the jamming, accumulator, damming effect which occurs as the fibrous web is forced through the ever diminishing slot until upon exiting therefrom it undergoes the previously discussed aerodynamic flight and randomizing of orientation of the axial directions of the constituent fibers.

In this embodiment, the web now randomized is split in the customary fashion by encountering in sequence the two doffer rolls DT and DB, a portion of the web being removed by the first doffer DT and the remainder being removed by the second doffer DB. As shown, if desired a further carding segment C4 may be introduced between the interaction areas of the two doffers DT and DB with the toothed cylinder T; if desired this carding element C4 may indeed be fashioned as a part of yet another combination of carder and web former similar to that of the carder C3 combination with web former ZM, and should this be done the combination may be designated C4ZM. As shown, however, only carder C4 is in position in this embodiment.

In the foregoing embodiments, from five to seven carding cylinders are (in these numbers are included the toothed rolls T which usually may bear card clothing to provide the toothing) of relatively small diameter compared to the carding cylinders most usually used in the art. Although carders of this type, employing as cooperating elements worker rolls or other carding segments, are of themselves not distinctly new, here in the context of the present invention they offer special utility. The cylinders marked K and T are moved at progressively greater and greater rotational speeds along the flowpath of web movement. The doffing cylinders usually are rotated at a lower surface speed than the carding or toothed cylinders with which they cooperate to doff web. If a carding cylinder follows a doffing cylinder in the web flowpath, usually it is operated at either the same or a higher rotational or surface speed as or than the preceding doffer cylinder; in this instance see FIG. 1, where carder T follows doffer D0. The use of relatively small diameter carding cylinders permits one to select the exact degree of carding desired for any specific stock, and combine therewith any desired number and type of combination of this invention, namely a carder followed almost immediately by a web former, or a carder and web former used concurrently with, for example, the carder being a part of the web former for purposes of randomizing the web.

The value of such flexibility is now easily recognized from a consideration of the foregoing descriptions. Yet further, enhanced value is obtained in that now one may obtain and in fact predetermine and prescribe the exact degree of web thickness, the exact degree of randomization of axial orientation of the constituent fibers thereof, and thus the precise degree of isotropy of properties of the resultant nonwoven web product obtained, and at very high production rates.

Those knowledgeable in the art may easily contemplate yet further advantages provided through the use of the principles of the present invention and of variations from the specific exemplary embodiments described above which would yet fall within the scope of the present invention to achieve such objectives and provide such advantages.

While it is not known the exact mechanisms through which the invention works to provide such prescribability of end product properties, the operative principles as hereinbefore described and now defined in the claims are herewith made known.

I claim:

1. In a method for forming a random fibrous web from staple fibers, including disentanglement of the constituent fibers of fibrous flow and forming a web thereof wherein said fibers are aligned substantially axially parallel to one another through a carding action produced by carding means, and then randomizing the axial orientation of the fibers to provide a more isotropic web structure, the improvement comprising both carding and effecting jamming and randomizing of the fibers on the same carding means.

2. The method of claim 1, wherein said carding is pursued concurrently with said jamming.

3. The method of claim 1, wherein said carding is pursued immediately prior to said jamming.

4. The method of claim 1 wherein said carding means is provided by a series of tandomly arranged carding cylinders.

5. In a carding assemblage for producing a random fibrous web from staple fibers, including means for receiving fibrous flock, means for carding said flock to align the constituent fibers thereof axially parallel one another, and means for randomizing the directions of the axes of said fibers through aerodynamic and centrifugal action employing a jamming effect on said fibers, the improvement including means for both carding and effecting jamming and randomizing the fibers on the same toothed cylinder.

6. The improvement as in claim 5, wherein said means for carding and jamming causes said carding to be followed immediately by said jamming.

7. The improvement as in claim 5, wherein said means for carding and jamming causes said carding and jamming to occur concurrently.

8. The improvement of claim 5 further including a number of carding cylinders arranged tandomly in series prior to said cylinder.

* * * * *